US010314383B2

(12) United States Patent
Thompson

(10) Patent No.: US 10,314,383 B2
(45) **Date of Patent: *Jun. 11, 2019**

(54) WEARABLE SPORTS EQUIPMENT CARRIER WITH PERSONAL FLOTATION DEVICE

(71) Applicant: Gary McClellan Thompson, El Segundo, CA (US)

(72) Inventor: Gary McClellan Thompson, El Segundo, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/488,044

(22) Filed: Apr. 14, 2017

(65) Prior Publication Data

US 2017/0215561 A1 Aug. 3, 2017

Related U.S. Application Data

(63) Continuation-in-part of application No. 15/083,559, filed on Mar. 29, 2016, now Pat. No. 9,801,454.
(Continued)

(51) Int. Cl.

| | |
|---|---|
| ***A45F 3/14*** | (2006.01) |
| ***A45F 4/00*** | (2006.01) |
| ***B63B 35/79*** | (2006.01) |

(52) U.S. Cl.
CPC ..... *A45F 3/14* (2013.01); *A45F 4/00* (2013.01); *B63B 35/7946* (2013.01); *A45F 2003/142* (2013.01); *A45F 2004/006* (2013.01)

(58) Field of Classification Search
CPC ..... A45F 3/14; A45F 3/02; A45F 2003/142; A45F 2005/1013; A45F 2005/1006; A45F 2005/006; A45F 5/00; A63C 11/025; B65D 63/16; B65D 2312/02; B63B 35/746; B63B 35/79; B63B 35/7946; Y10S 224/917; Y10T 24/27; Y10T 24/2708; Y10T 24/4084
(Continued)

(56) References Cited

U.S. PATENT DOCUMENTS

| | | | |
|---|---|---|---|
| 2,490,597 | A | 12/1949 | Niederhiser |
| 3,225,842 | A | 12/1965 | Roeschen |

(Continued)

FOREIGN PATENT DOCUMENTS

| | | | |
|---|---|---|---|
| DE | 3225842 | A1 | 2/1984 |
| FR | 2490597 | A1 | 3/1982 |

(Continued)

*Primary Examiner* — Adam J Waggenspack

(57) ABSTRACT

A device for carrying a surfboard, similar sporting equipment or other objects. One embodiment is comprised of webbing material with fixed loop having a loop buckle that slides along the fixed loop and a strap element that in combination with the loop buckle creates a secondary adjustable loop. The secondary adjustable loop is used to hold a surfboard or other object securely in place and the fixed loop supports the surfboard from one of the user's shoulder allowing hands free operation. When not utilized as a carrier the device can be worn, such as a belt. The user keeps the fixed loop compressed together, wraps the carrier around his/her waist, through the loop buckle and then attaches it back onto itself. A personal flotation device can be attached to the strap element so that the carrier and personal flotation device form a single unit.

19 Claims, 10 Drawing Sheets

Related U.S. Application Data

(60) Provisional application No. 62/369,001, filed on Jul. 29, 2016, provisional application No. 62/140,382, filed on Mar. 30, 2015.

(58) Field of Classification Search
USPC ..... 224/250, 257–258; D3/221
See application file for complete search history.

(56) References Cited

U.S. PATENT DOCUMENTS

| | | | | |
|---|---|---|---|---|
| 3,591,063 | A | 7/1971 | Pearce | |
| 3,777,007 | A | 12/1973 | Gould et al. | |
| 4,483,380 | A | 11/1984 | Beran | |
| 4,724,989 | A | 2/1988 | Silberberg | |
| 4,804,025 | A | 2/1989 | Bear | |
| 5,094,344 | A | 3/1992 | Savage | |
| 5,110,023 | A | 5/1992 | Colin | |
| D390,001 | S | 2/1998 | Lovelady et al. | |
| 5,823,551 | A | 10/1998 | Conroy | |
| D657,553 | S | 4/2012 | Benson | |
| 8,501,194 | B2 | 8/2013 | Spector et al. | |
| D703,950 | S | 5/2014 | Vitale | |
| 9,801,454 | B2 * | 10/2017 | Thompson | A45F 3/14 |
| 2004/0056060 | A1 | 3/2004 | Iannini et al. | |
| 2005/0184118 | A1 * | 8/2005 | Vella | A45F 3/02 224/625 |
| 2005/0236450 | A1 | 10/2005 | Iannini | |
| 2008/0057805 | A1 | 3/2008 | Alexander | |

FOREIGN PATENT DOCUMENTS

| | | |
|---|---|---|
| WO | 85/01194 | 3/1985 |
| WO | 95/01112 | 1/1995 |

* cited by examiner

WEARABLE SPORTS EQUIPMENT CARRIER WITH PERSONAL FLOTATION DEVICE

CROSS-REFERENCE TO RELATED APPLICATIONS

This application is a continuation-in-part application of U.S. patent application Ser. No. 15/083,559, titled, "SPORTS EQUIPMENT CARRIER WHICH CAN BE WORN", filed Mar. 29, 2016, which claims the benefit of the priority date of U.S. Provisional Patent Application Ser. No. 62/140,382, titled, "SPORTS EQUIPMENT CARRIER WHICH CAN BE WORN", filed Mar. 30, 2015.

This application also claims the benefit of the priority date of U.S. Provisional Patent Application Ser. No. 62/369,001, titled, "Wearable sports equipment carrier with a personal flotation device", filed Jul. 29, 2016.

BACKGROUND OF THE INVENTION

1. Field of the Invention

This invention relates to a device for carrying sports equipment such as surfboards, stand up paddleboards (SUP), snowboards, snow skis, and the like, where the carrier device is self-adjusting to the size of the object being carried, and the device can be worn as a belt with an integral personal flotation device (PFD) when not carrying the sports equipment.

2. Background

The following is a tabulation of some prior art that presently appears relevant:

U.S. patents

| U.S. Pat. No. | Kind Code | Issue Date | Patentee |
|---|---|---|---|
| 3,777,007 | 224-205 | August 1968 | Gaylor |
| 3,591,063 | 224-55 | July 1971 | Pearce |
| 4,483,380 | 206/315.1 | November 1984 | Beran |
| 4,804,025 | 224/604 | February 1989 | Bear |
| 5,094,344 | 206/315.1 | March 1992 | Savage |
| 4,724,989 | 224/609 | February 1988 | Silberberg |
| 5,823,551 | 280/47.131 | October 1998 | Conroy |

Foreign Patent Documents

| Foreign Doc. Nr. | Kind Code | Publ. Date | Country |
|---|---|---|---|
| 2490597 | 224/917 | March 1982 | France |
| 3225842 | 206/523 | February 1984 | Germany |
| 8501194 | 224/917 | March 1985 | PCT Int'l Appl. |
| 20050236450 | 224/577.000 | Oct. 27, 2005 | PCT Int'l Appl. |
| 20080057805 | B63B 35/79 | June 2008 | PCT Int'l Appl. |

Carrying an article like a surfboard or stand up paddleboard (SUP) to and from the water has always been a problem since the inception of surfing. Surfboard designers design surfboards to facilitate their functionality while in the water. The width of a surfboard or SUP contributes to its floating capability and thus its performance. As the width of the board increases to improve performance, it becomes more difficult to carry. In some cases, people's arms are just not long enough to carry the surfboard or SUP. As result, many individuals have made attempts to solve this problem of carrying a surfboard to the water. These include the Sling for Surfboard (U.S. Pat. No. 3,777,007), Surfboard Carrier (U.S. Pat. No. 3,591,063), Foldable protective cover and carrier for sports equipment (U.S. Pat. No. 4,483,380), Carrying harness for surfboards and the like (U.S. Pat. No. 4,804,025), Surfboard carry case (U.S. Pat. No. 5,094,344), Sailboard carrying apparatus (U.S. Pat. No. 4,724,989), Surfboard or sailboard carrier (U.S. Pat. No. 5,823,551), System transport of machine water sport as, for example the windsurfing (U.S. Pat. No. 2,490,597), Transport protection for surfing equipment (U.S. Pat. No. 3,225,842), Carrying harness for rectangular or oval body and accessories (U.S. Pat. No. 8,501,194), Board sling (20050236450) and Devices and Methods for Carrying and Storing a Surfboard (20080057805).

All the above designs have had some deficiency in their approach. Two of the above patents U.S. Pat. Nos. 3,591,063 and 5,823,551 each require the use of at least one hand, thereby limiting the user's ability to carry other important equipment such as a wetsuit, cooler, towel, etc.

U.S. Pat. No. 3,777,007, PCT 8501194 and PCT 20080057805 each consist of two straps and some initial setup adjustments prior to use for the size of the surfboard and size of the user. A new setup would be required for a different user or a different size surfboard. This increases the time to utilize the device and discourages its use.

U.S. Pat. Nos. 4,483,380, 4,724,989 and 4,804,025 each utilize bars or rods in their approach. This complicates the assembly, has multiple parts and when not in use these bars and rods require additional area when transporting and storing them.

U.S. Pat. No. 5,094,344, PCT 20050236450, German Pat. No. 3225842 and France Pat. No. 2490597 are carrier style bags or blankets. The bag/blanket approach requires enough material to cover the surfboard which increases the cost to manufacture, store and ship.

Besides the deficiencies as described above, all of these solutions miss the one key element of the problem: a user needs to carry surfboards both to and from the water's edge. The ocean is a dynamic environment such that the entry and exit point of the water may not be the same. The ocean's longshore currents (side currents) could move the user hundreds of yards down the shore from where they entered. Therefore, what is needed is an apparatus that can go with the user into the water and be readily available for use upon exiting the water.

BRIEF SUMMARY OF THE INVENTION

In accordance with one embodiment, a wearable sports equipment carrier with a personal flotation device comprises a fixed loop, a buckle that can slide along the fixed loop and a strap element extending past the fixed loop attachment point. The strap element, working with the buckle creates a secondary adjustable loop having a user-defined size. The user can carry a surfboard or other object by using the fixed loop over a shoulder and the secondary adjustable loop around the surfboard. When not utilized as a carrier, the device can be worn, such as a belt. To use as a belt, the user keeps the fixed loop compressed together, wraps the carrier around his/her waist, through the buckle and then attaches it back onto itself. The carrier may also include an integrated personal flotation device (PFD) which provides additional safety for the surfer when the carrier is worn as a belt.

Accordingly, several advantages of one or more aspects are as follows: 1) the single strap carrier solution is very simple which makes it convenient and easy to use, 2) the weight of the object being carried causes the secondary adjustable loop to auto-tighten ensuring that the surfboard or other object is securely held in place allowing hands free operation, 3) the adjustability of the secondary loop allows a single embodiment to wrap many sizes surfboards or other objects and adjusts from a child size to a grown male adult, 4) the carrier can be made from a soft material that will not damage the surfboard, 5) the single strap carrier design conveniently converts to a belt that allows it to travel with the user, 6) when it is not utilized to carry a surfboard or worn as a belt it can be folded together to reduce its size for convenient storage, 7) the single strap carrier embodiment also makes it less expensive to manufacture, 8) the integral PFD allows a single device to be used for surfboard carrying on land and surfer safety when in the water, and 9) for situations where the carrier is being used to carry a heavy load, a weight transfer strap can be used to share the weight between the user's waist and hips, thus reducing the pressure on the user's shoulder. These and other benefits for one or more aspects will become apparent from consideration of the following description and accompanying drawings.

Figure 1:
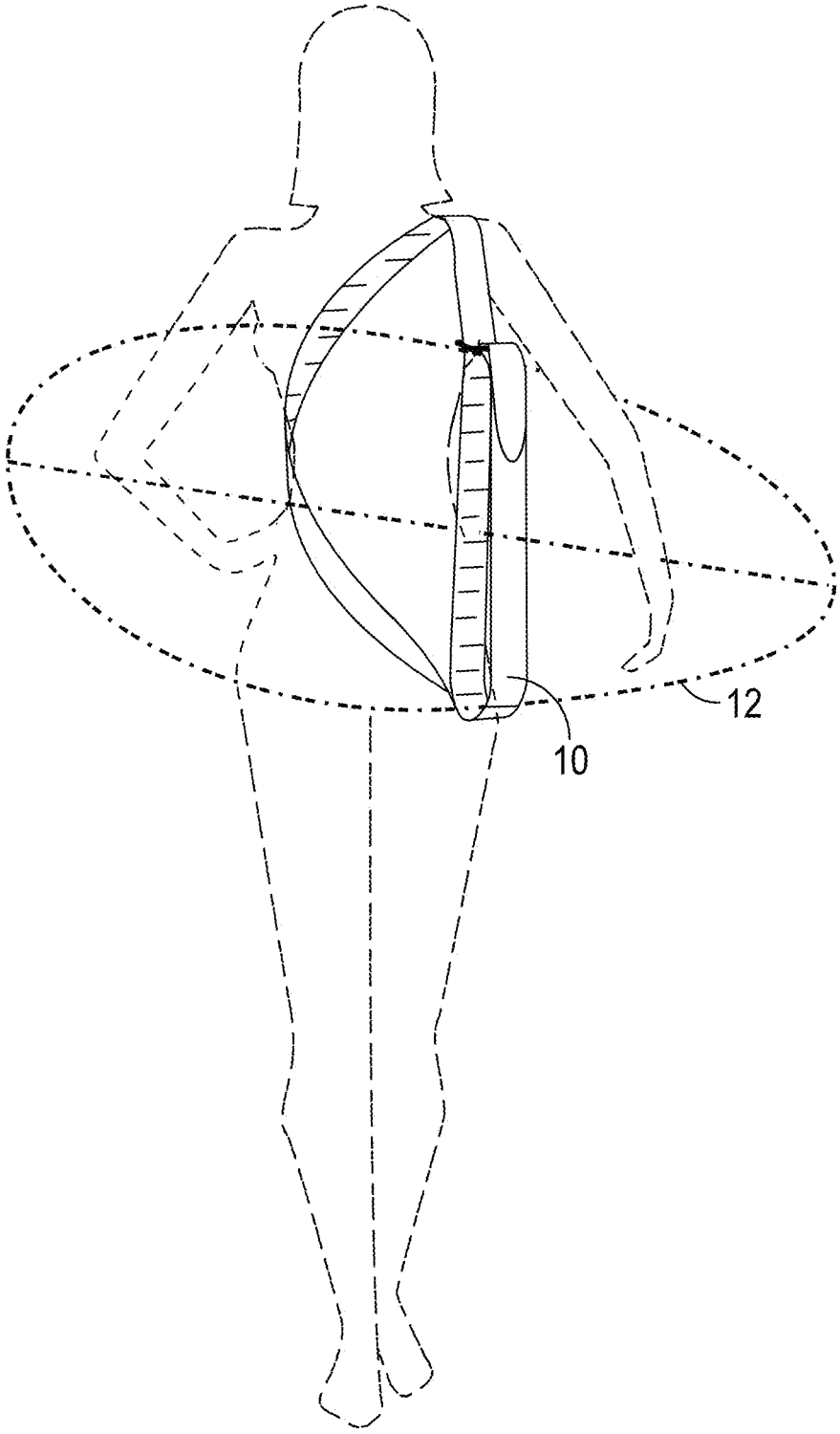
FIG. 1 shows a perspective view of a wearable sports equipment carrier carrying a surfboard.

The dashed lines of the individual and surfboard shown in FIG. 1, FIG. 2, FIG. 5, FIG. 6, FIG. 7, FIG. 8 and FIG. 10 are for illustrative purpose only and form no part of the claimed design. The wearable sports equipment carrier is shown with broken away lines in FIGS. 3 and 12-15 to indicate indeterminate length.

Following is a list of Item Reference Numerals shown in the Drawings:

- sports equipment carrier 10
- surfboard 12
- strap element 20
- loop buckle 22
- two opening loop buckle 22A
- fixed loop element 24
- end junction point 26 (where the webbing is attached to itself to form a fixed loop)
- tongue 28 (can be made with hook fastener)
- attachment-surface 30 (can be made with a loop fastener)
- hook length-reducer 32 (can be made with a hook fastener)
- loop length-reducer 34 (can be made with a loop fastener)
- personal flotation device 36 (can be attached to the strap element 20)
- female buckle 38
- male buckle 40
- strap buckle extender 42
- fixed loop element assembly 44 (consists of a fixed loop element 24, a loop buckle 22, a strap buckle extender 42, a female buckle 38, another strap buckle extender 42 and a male buckle 40)
- weight distribution belt 50
- weight transfer strap 52
- hook fastener patch 48
- loop fastener patch 58

DETAILED DESCRIPTION OF THE INVENTION

Figure 2:
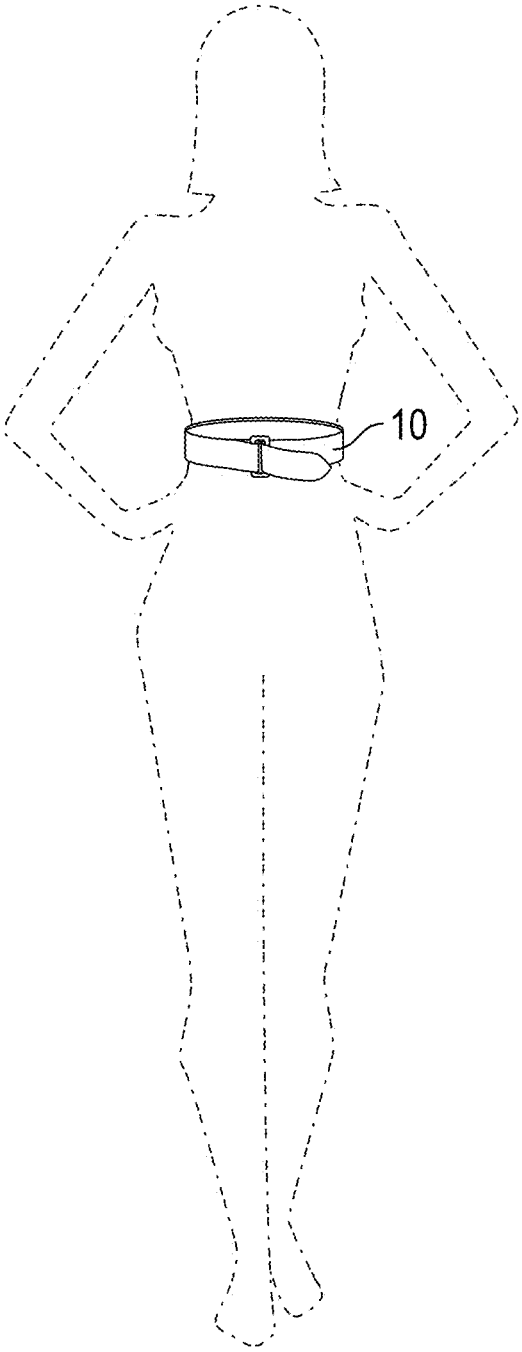
FIG. 2 shows a perspective view of a wearable sports equipment carrier being worn as a belt.

A wearable sports equipment carrier 10 according to embodiments of the disclosed invention is shown in FIGS. 1 and 2. In FIG. 1, the carrier 10 is being used to carry a surfboard 12. In FIG. 2, the carrier 10 is being worn as a belt, providing the hands-free portability advantages discussed above.

Figure 3:
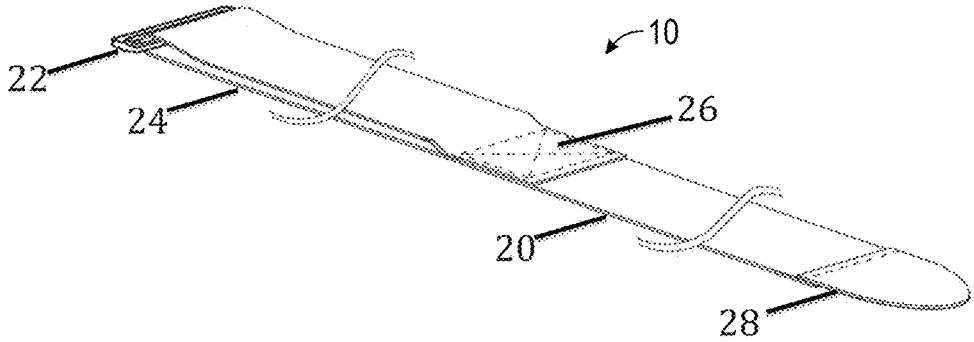
FIG. 3 shows a perspective view of a sports equipment carrier.

One embodiment of the wearable sports equipment carrier 10 (not yet depicted with a personal flotation device) is shown in FIG. 3. The carrier 10 is preferably fabricated from a polyester, polypropylene or nylon webbing but can be fabricated from any thin flexible strap, belt or equivalent material. While dimensions can vary, a reasonable size is generally about 5.08 cm (2") wide and 2.44 m (8') long. In general, pieces attaching to this webbing share its width (5.08 cm (2")) and only the length will be specified. Furthermore, it shall be assumed that throughout this description the attachment method for attached pieces will be sewing or some other suitable method.

One end of the webbing is inserted through a free moving loop buckle 22 and folds back and attaches to itself to form a fixed loop element 24. The length of the webbing used to form the attachment junction point 26 should be sufficient length to provide a good connection for the type of material used; generally, about 5.08 cm (2") long works well. The fixed loop element 24 length can be chosen for the size of the person using the carrier and the object to be carried. Additionally, with some selection in fixed loop 24 and strap element 20 lengths the wearable sports equipment carrier can accommodate a variety of different size surfboards and users. Generally, about ⅔ the length of the webbing material is used to form the fixed loop element 24 leaving approximately ⅓ its length leftover after the end junction point 26 to form a strap element 20.

Figure 4:
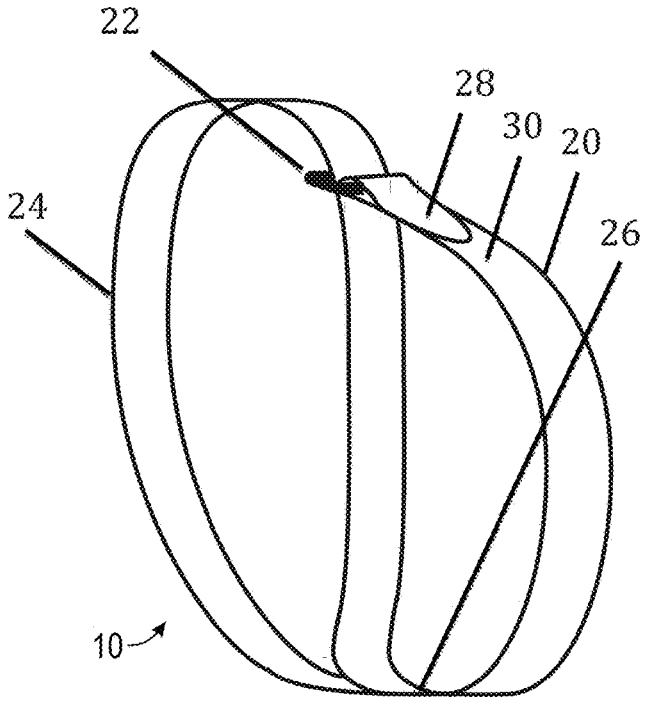
FIG. 4 shows a perspective view of a wearable sports equipment carrier without user and without surfboard.
Figure 5:
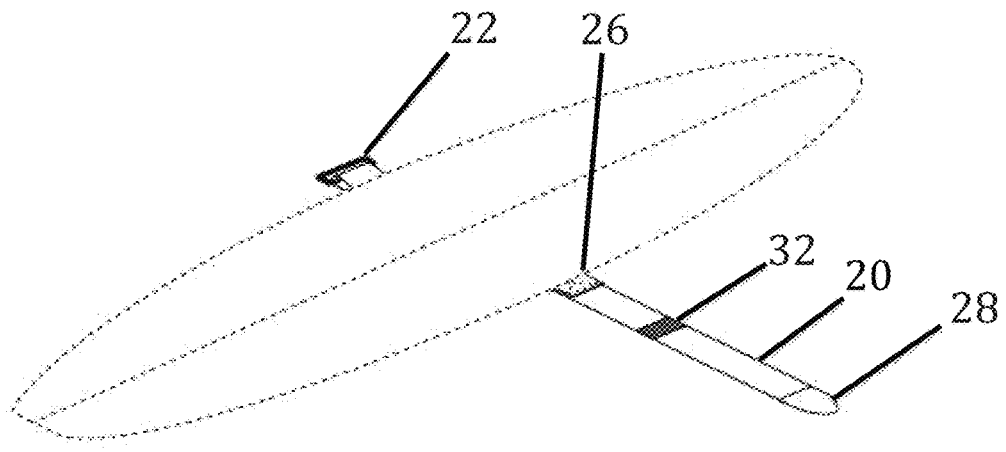
FIG. 5 shows a perspective view of a wearable sports equipment carrier under a surfboard.
Figure 6:
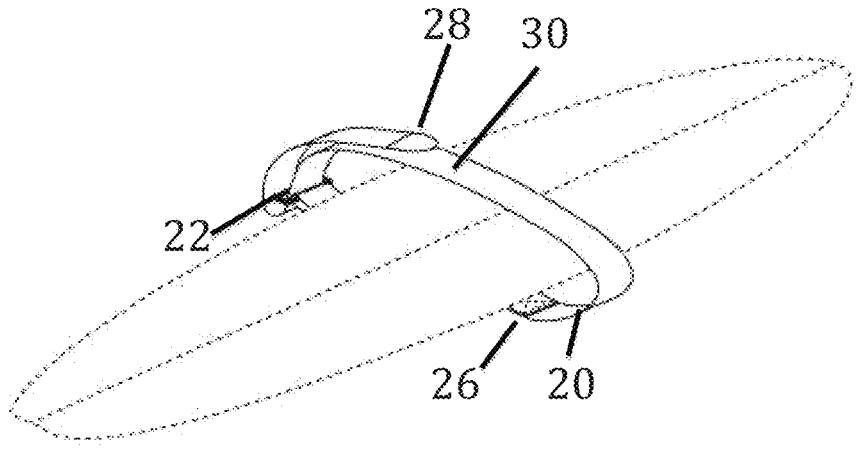
FIG. 6 shows a perspective view of a wearable sports equipment carrier being wrapped around a surfboard.

At the end of the strap element 20 can be a tongue 28 which can be made using a hook fastener. The tongue 28 length can vary but generally about 5.08 cm (2") long is a sufficient to form a good attachment when mated to a loop fastener. When hook fastener is used the hook attaches to the webbing so that the hook's surface is on the opposite side of the webbing from the junction point 26. That is, if the webbing is held horizontal, with the junction point 26 facing up then the hook surface would be facing down (see FIGS. 13 and 14). If the tongue 28 was made from a hook fastener, then attachment-surface 30 would be made from a loop fastener. The attachment-surface 30 attaches to the webbing so that the loop surface faces the same direction as the hook surface of the tongue 28. The attachment-surface 30 can extend the entire length of the wearable sports equipment carrier with the one edge beginning at the tongue 28 and the other the edge ending at the fixed loop 24 center fold-over point (see FIG. 14). However, its length can be reduced and chosen for the waist size of its largest user. Generally, a size of at least 1.1 m (44") works well to accommodate extra large waist size (XXL). The hook and loop of connecting surfaces face the same direction so that when the tongue 28 passes through the loop buckle 22 and folds back towards the attachment-surface 30 they can form a hook/loop type attachment (FIG. 4).

The wearable sports equipment carrier 10 can be used to carry a surfboard 12 or other object (SUP, snowboard, snow skis, sports equipment bags, mountain bicycles, firewood, lumber, etc.) by wrapping it around the lengthwise center of the surfboard, or object, at roughly the center of mass. To utilize the carrier, the user can lay the carrier with the hook surface of the tongue 28 facing the ground. Slide the loop buckle 22 to approximately the center fold-over point of the fixed loop 24 leaving it easily accessible when the surfboard is in place. Lay the surfboard onto the carrier so its approximate center of mass is on top of the carrier and the length of the surfboard is perpendicular to the length of the carrier (see FIG. 5). Position the surfboard so that one lengthwise edge of the surfboard is approximately over the end junction point 26 of the carrier and the other lengthwise edge of the surfboard is nearest to the loop buckle 22. This should leave the strap element 20 uncovered. Take the tongue 28 with the strap element 20 and wrap it over the surfboard and feed it through the loop buckle 22 and back onto attachment-surface 30 to form a hook/loop type attachment (see FIG. 6). This attachment produces a secondary adjustable loop.

Increasing the distance from loop buckle 22 to the end of the tongue 28 decreases the secondary loop for a narrower surfboard or a shorter person. Conversely, decreasing the distance from loop buckle 22 to the end of the tongue 28 increases the secondary loop size for a wider surfboard or taller person. This adjustment is best performed when the surfboard is held in place by the secondary adjustable loop and the carrier is on the user (see FIG. 1). Thus, it is easiest to start with a larger secondary adjustable loop by attaching the tongue 28 close to the loop buckle 22 and then reduce it to the desired size. Next, pull the webbing of the fixed loop 24 away from the loop buckle 22 which causes the secondary loop to tighten around the surfboard. By lifting the fixed loop 24 up, the surfboard can be transitioned to a vertical position (see FIG. 7) where the surfboard's weight causes the secondary adjustable loop to tighten holding the surfboard in place. Thus, the wearable sports equipment carrier is auto-tightening to hold a surfboard securely in place. The fixed loop 24 portion of the carrier can be used to hang on a shoulder or across the body of the user to carry a surfboard (see FIG. 1 for a user with a surfboard or FIG. 4 for the carrier by itself).

While an embodiment(s) of the wearable sports equipment carrier 10 has distinct advantages over one or more aspects of prior art in that it is quick to install (approximately 15 seconds), is auto-tightening (holding the surfboard in place), and is easily adjustable for many sizes (in seconds), it also has the distinct advantage over prior art for its ability to convert into a belt and travel with the user.

This wearable belt configuration is accomplished by putting the carrier in a full-length position and sliding the loop buckle 22 to the end which is approximately the center fold-over point of the fixed loop 24. The user shall position the carrier around the waist of his/her body with the loop buckle 22 in one hand and the tongue 28 in the other with both the hook and loop surfaces facing away from the body. Take the tongue 28 of the strap element 20 and wrap it around the waist and feed it through the loop buckle 22 and fold it back onto the attachment-surface 30 forming a belt held in place by the hook/loop type attachment (see FIG. 2).

Figure 14:
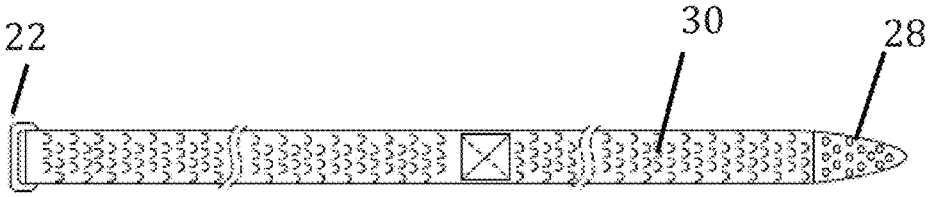
FIG. 14 shows a bottom plan view of the carrier.
Figure 15:
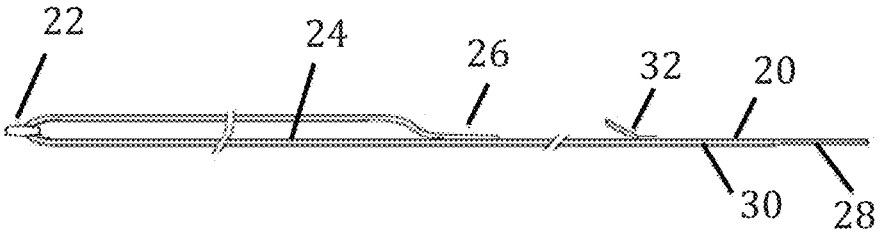
FIG. 15 shows a left elevation view of the carrier.
Figure 16:
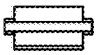
FIG. 16 shows a front elevation view of the carrier.
Figure 17:
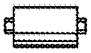
FIG. 17 shows a rear elevation view of the carrier.

Another embodiment(s) of wearable sports equipment carrier can be made for users whose waist size is proportionally smaller with respect to the width of the surfboard. For this embodiment, the user makes a smaller belt by first folding the carrier back on itself. To do this, a hook length-reducer 32 and a loop length-reducer 34 are added to the carrier (see FIGS. 8 & 9). The loop reducer 34 is not required if the attachment-surface 30 extends the entire length of the wearable sports equipment carrier as shown in FIG. 14. The loop reducer 34 can be made from loop fastener with a length about 3.81 cm (1.5") long. The loop reducer 34 is attached with its loop surface facing out and on the same side as the attachment-surface 30. It is attached so that it is edge-to-edge with the center fold-over point of the fixed loop 24.

The hook length-reducer 32 can be made from a hook fastener with a length of 6.35 cm (2.5"). The hook reducer 32 is positioned so that when the hook/loop connection is made the folded carrier length becomes the same length as the attachment-surface 30 as described above (for example 1.1 m (44")). When a folded carrier has an attachment-surface 30 length of 1.1 m (44") the carrier will accommodate a waist size from 1.1 m (44") down to half that length or 0.55 m (22"). The hook reducer 32 is attached on the same side of the webbing as the junction point 26. In this embodiment, it is preferable to attach the hook reducer 32 with the hook surface facing in towards the webbing (the reason for this will soon become evident). In addition, attach only a portion (approximately 20%) of the hook material (approximately 1.27 cm (0.5")) to the webbing leaving the majority of the hook surface (5.08 cm (2")) available to fold up and mate with the loop.

Attaching the hook surface facing the webbing has two advantages. The first advantage is that the smooth side, and not the hook surface, is exposed to surface wax when wrapping and carrying a surfboard. This prevents wax build up on the hook surface interfering with its ability to function as loop fastener receiver. The second advantage increases the structural strength of the hook and loop connection. The ocean can be a turbulent environment with many forces acting at many angles. With the hook facing the webbing it takes more perpendicular force upon the strap element 20 to break the hook/loop connection and thus there is a lower probably the ocean will break their attachment apart resulting in the loss of the belt.

Figure 8:
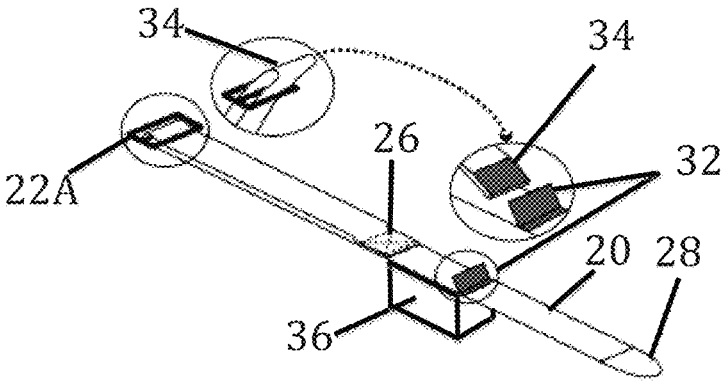
FIG. 8 shows a perspective view of a wearable sports equipment carrier folding down to reduce the belt size and includes a personal flotation device.
Figure 9:
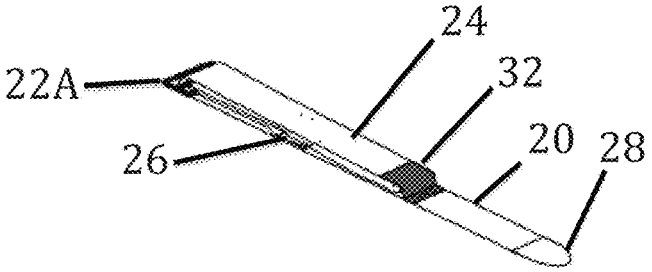
FIG. 9 shows a perspective view of a wearable sports equipment carrier folded to become a belt laid flat.

As described above, the attachment-surface 30 or loop reducer 34 can be connected to the hook reducer 32 (see FIG. 8). This folded carrier makes for a smaller belt (see FIG. 9). When using this length shortening technique a two opening loop buckle 22A (see FIG. 8) is preferred over a standard single opening loop buckle 22 (see FIG. 3). When the carrier is folded over to be worn as a belt the second inner opening of the two opening loop buckle 22A holds the inner fold of the webbing in place when it is in the folded position (see FIGS. 9. and 10). This prevents the inner fold from being dislodged in the ocean's turbulent environment and reducing the tension on the belt.

Another embodiment(s) of wearable sports equipment carrier can incorporate a personal flotation device 36 which is out of the way when the carrier is used to carry a surfboard but operational as a personal flotation device when the carrier is worn as a belt. For this embodiment, the personal flotation device (PFD) 36 is attached to the strap element 20 (see FIG. 7) so that when it is used as a carrier it resides out of the way along the width of the surfboard (see FIG. 8). When the wearable sports equipment carrier is used as a belt (see FIG. 10) the PFD 36 provides typical belt-type personal flotation device functionality.

Figure 18:
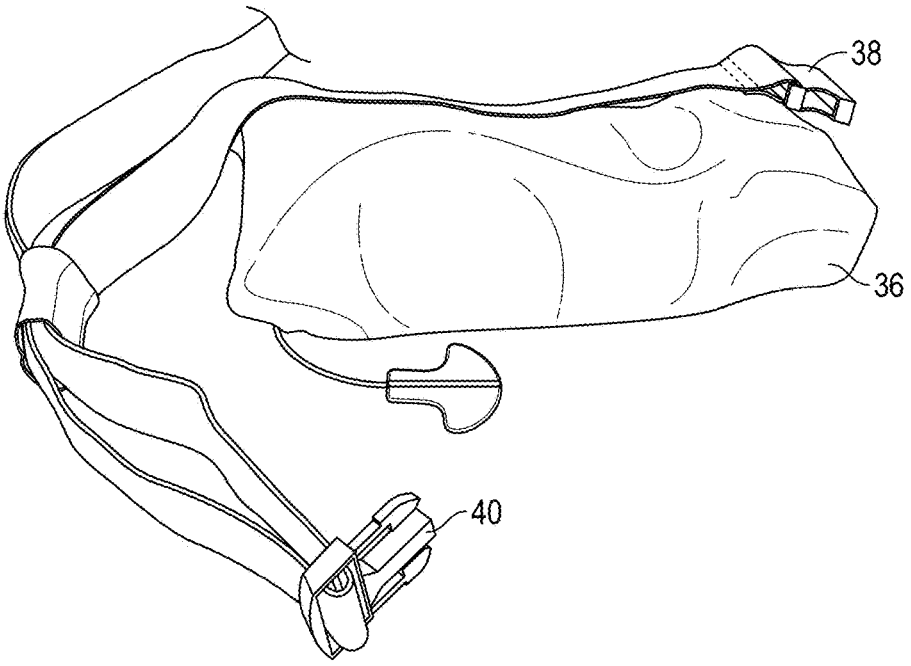
FIG. 18 shows an example of a personal flotation device which may be used with the wearable sports equipment carrier.
Figure 19:
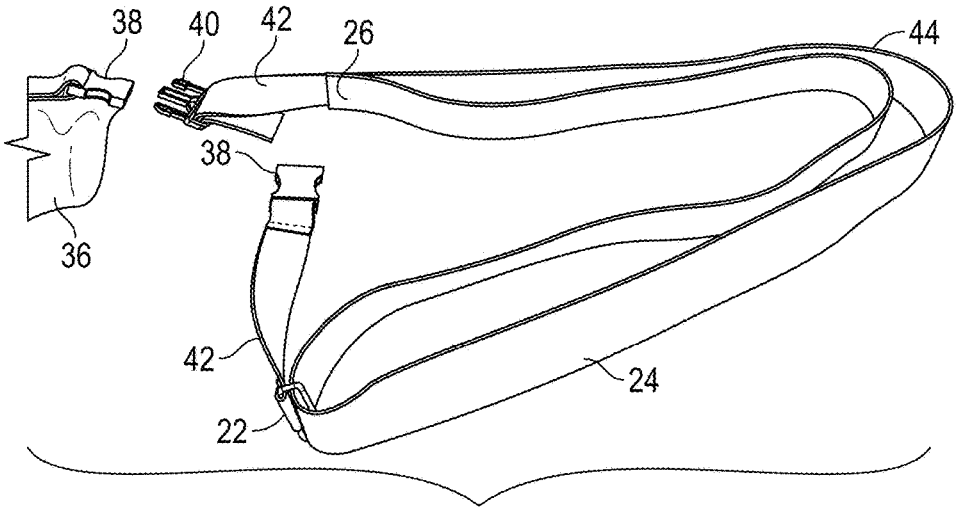
FIG. 19 shows an example of a fixed loop element assembly which mates to connectors of a personal flotation device.
Figure 20:
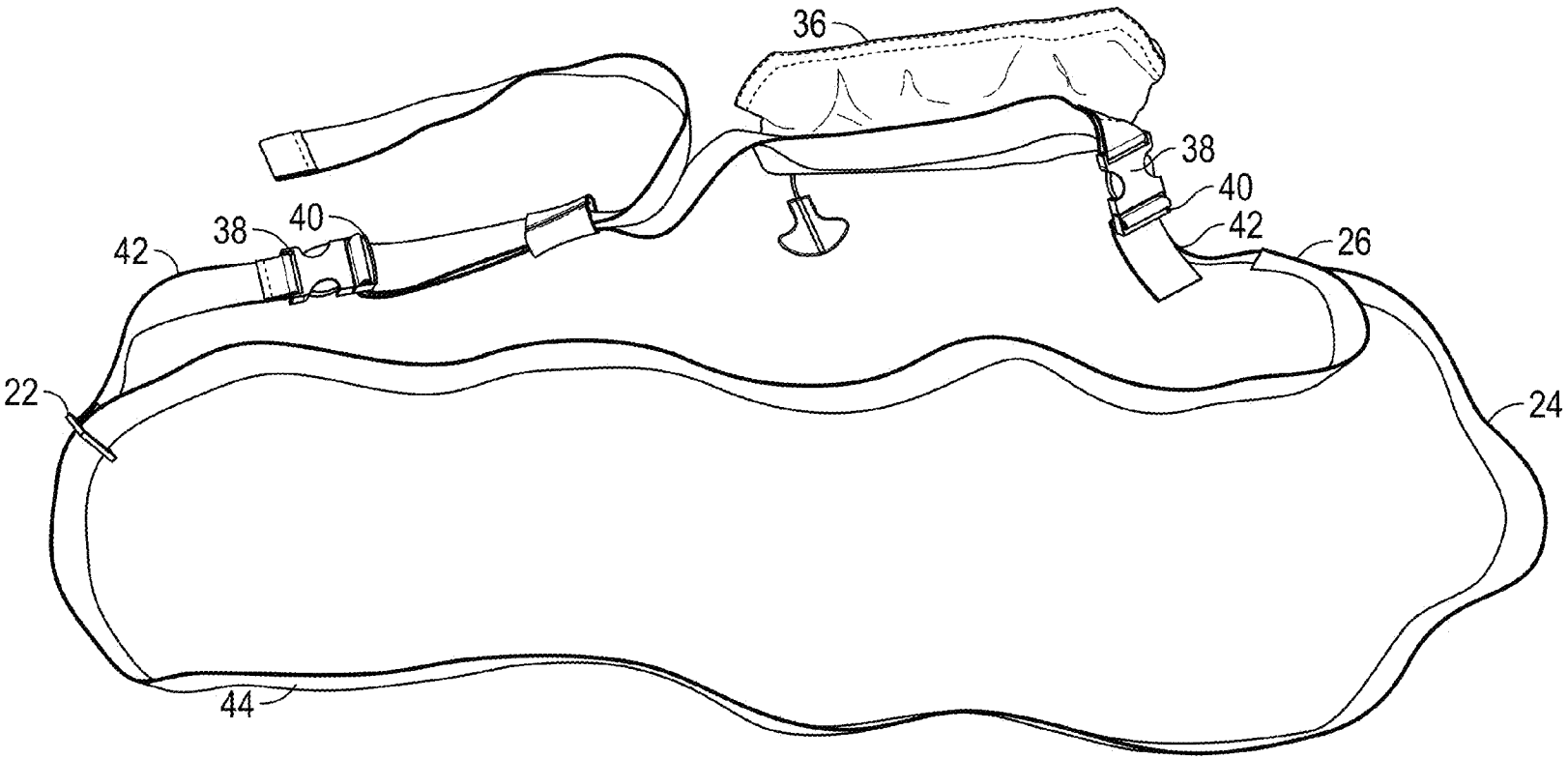
FIG. 20 shows an example of a wearable sports equipment carrier including a personal flotation device connected to a fixed loop element assembly.

FIGS. 18-20 show a design configuration of the wearable sports equipment carrier where the hook-and-loop fastener attachment approach is replaced by a two-piece snap buckle of the type commonly used in sports equipment, backpacks, etc. These male-and-female buckle embodiment(s) of the wearable sports equipment carrier can use an existing personal flotation device (PFD) 36 with its own connectors 38 and 40 (see FIG. 18) in lieu of the strap element 20 and connect a fixed loop element assembly 44 (see FIG. 19) to the PFD 36 using the existing PFD's connectors 38 and 40 so that the combination of the PFD 36 and the fixed loop element assembly 44 becomes a wearable sports equipment carrier with a personal flotation device. The fixed loop assembly 44 consists of the fixed loop element 24 having a free moving loop buckle 22 retained thereon, a female connector 38 attached to the loop buckle 22 by a strap buckle extender 42 between the female connector 38 and the loop buckle 22, and a male connector 40 attached to the end junction point 26 by a strap buckle extender 42 between the male connector 40 and the end junction point 26 (see FIG. 19).

The purpose of the strap buckle extender 42 is to ensure that, when the female 38 and male 40 connectors are mated, their hard surface lays on a flat plane of the surfboard (e.g., the bottom) and not on the rounded edge of the surfboard which could damage the surfboard edge. Generally, the distance of the strap buckle extender 42 between the two attachment points is the maximum thickness of the surfboard or SUP for which the carrier is designed, or approximately about 10.16 cm (4") inches. The size of the secondary adjustable loop is now changed by increasing or decreasing the loop length with the adjustment capability of the male connector 40 similar to the method described above for the tongue 28 through the loop buckle 22 and attachment-surface 30 connection.

FIG. 20 shows the sports equipment carrier assembled with the PFD 36, where the fixed loop element 24 (worn over user's shoulder) is at the bottom, and the secondary adjustable loop (which holds the surfboard) with PFD 36 is at the top. It is noted that the configuration of the sports equipment carrier shown in FIG. 20 can be used with (FIG. 20) or without (FIG. 19) the separate PFD 36, both in the surfboard-carrying mode and in the wearable belt mode. Furthermore, the sports equipment carrier of FIG. 20 can be simplified by making the female buckle 38 (at left) slidable and positioning it in place of the loop buckle 22A; then the male buckle 40 (at right) can be attached to the female buckle 38 to form the secondary adjustable loop.

To summarize, the embodiments of the wearable sports equipment carrier include: a hook-and-loop fastener based design (FIGS. 3-15), with or without the PFD 36 attached (such as be sewing) directly to the strap element 20 (FIG. 10); and a male-and-female buckle based design (FIGS. 19-20), with or without the PFD 36 attachable in series with the fixed loop element assembly 44. The buckle-based design could also include the PFD 36 attached directly to the strap element 20. All of these design embodiments are operable in a surfboard carrying mode and a wearable belt mode, providing the user with an optimal combination of utility, convenience and safety enhancement. In any of these embodiments, the PFD 36 is preferably a compact, inflatable flotation device which manually inflates when the wearer pulls a "jerk to inflate" handle. This type of PFD—sometimes referred to as a belt-type—provides unrestricted motion and movement for the user due to the minimal PFD bulk. Inflation is achieved via a compressed gas cartridge (such as $CO_2$) which is discharged when the inflation handle is pulled.

Figure 21:
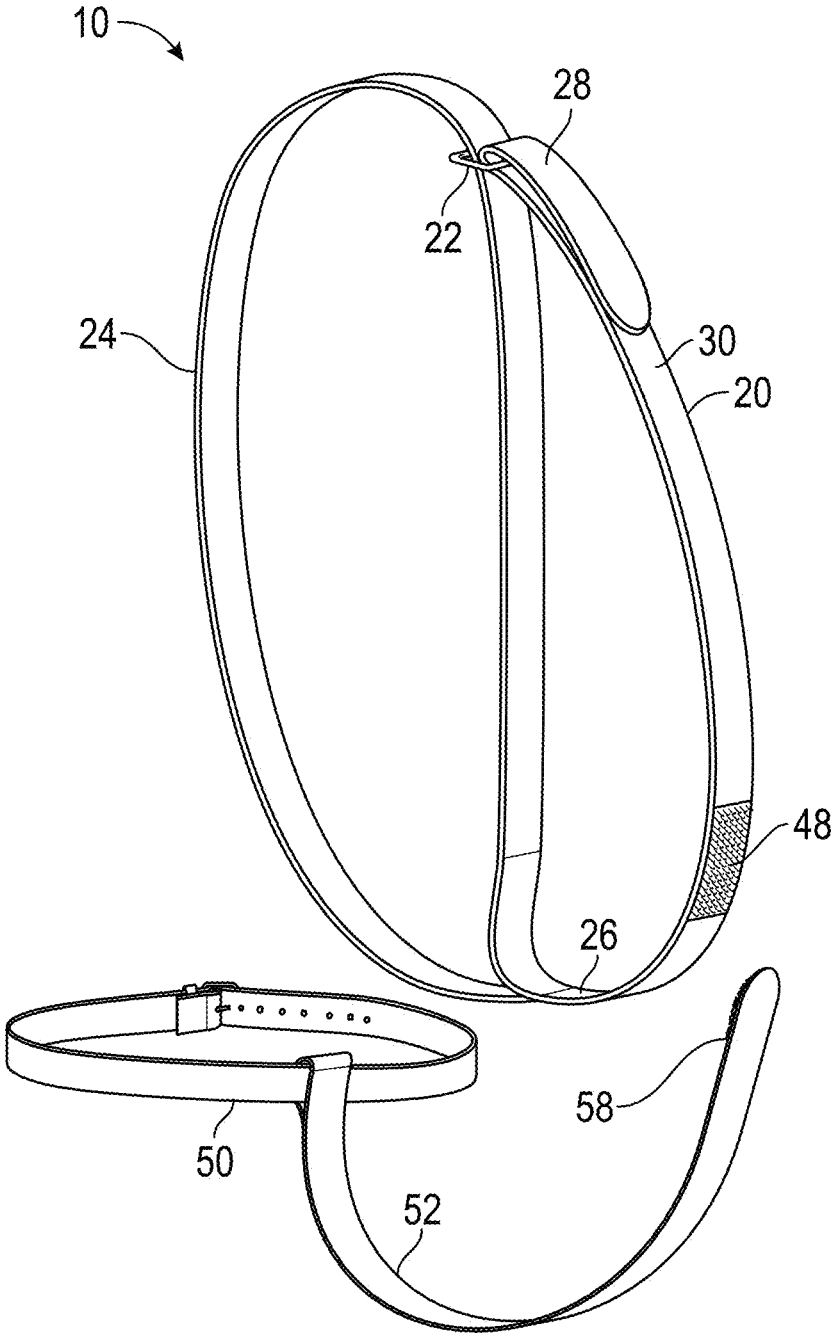
FIG. 21 shows an embodiment of a wearable sports equipment carrier system including a separate belt and weight transfer strap.

FIG. 21 is an illustration of an embodiment of a wearable sports equipment carrier system including a separate weight distribution belt 50 and a weight transfer strap 52. The belt 50 and strap 52 may be used in conjunction with the carrier 10 for situations where the carrier 10 is being used to carry a heavy load. For example, if the carrier 10 is being used to carry a heavy surfboard or even something like a bag of concrete, the weight of the heavy load may cause user discomfort where the fixed loop element 24 bears on the user's shoulder. Using the weight distribution belt 50 and the weight transfer strap 52, part of the weight of the load can be borne by the user's waist and hips, thus reducing the pressure on the user's shoulder.

The belt 50 can be fastened around the user's waist in any suitable fashion, such as with a snap buckle, a hook-and-loop fastener arrangement, or any other type of buckle. One end of the weight transfer strap 52 may be permanently or removably attached to the belt 50 so as to securely transfer a load. The other end of the weight transfer strap 52 may conveniently be attached to the strap element 20 using a hook fastener patch 48 on the strap element 20 and a loop fastener patch 58 on the weight transfer strap 52. The attachment of the weight transfer strap 52 to the strap element 20 can be adjusted by the user so that the weight transfer strap 52 pulls downward on the belt 50, thereby distributing the load between the belt 50 and the carrier 10.

The configurations described above are not the only embodiments of the disclosed invention. Alternatively:

- Different materials, size and interconnections can be used for all components
- The webbing material could be eliminated if the attachment-surface 30 is two sided
- In lieu of hook and loop some other fastening system like side release buckles, fasteners, snaps, buttons, etc. can be used for securing the surfboard or other object as seen in FIG. 20
- In lieu of a buckle or two opening buckle with hook and loop some other length adjusting system like a ring, etc. can be used In lieu of one fold, two or more folds could be made to further decrease the size of the carrier (see FIG. 11) and various connections and buckles can hold the folded material in place In lieu of a fixed loop, the fixed loop can be made adjustable with some fastening system to change its loop length In lieu of a continuous assembly the fixed loop and strap element can be made a separate assemblies and attached together similar to the assembly shown in FIG. 20.

Figure 7:
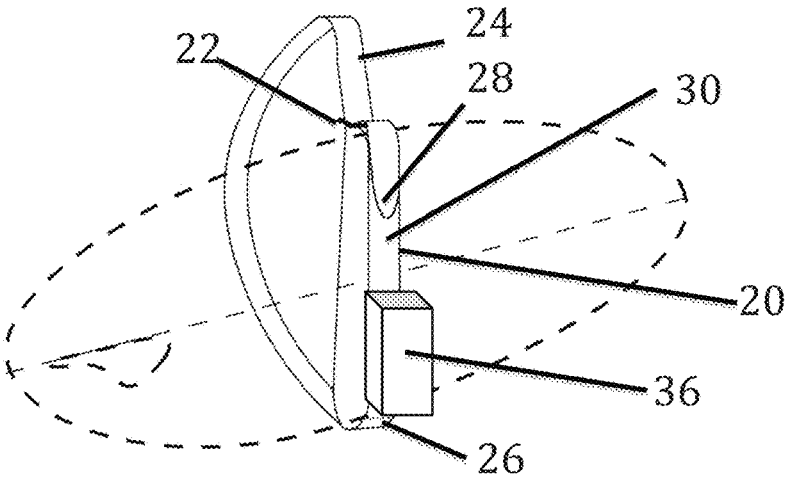
FIG. 7 shows a perspective view of a wearable sports equipment carrier lifting a surfboard and includes a personal flotation device.
Figure 10:
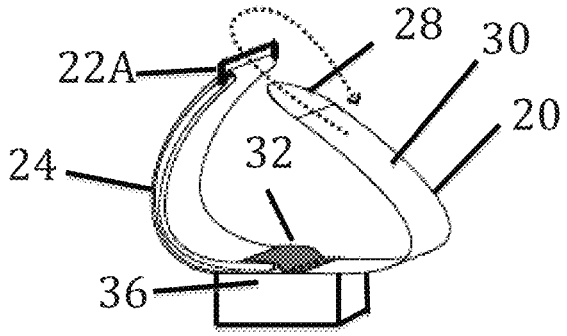
FIG. 10 shows a perspective view of a wearable sports equipment carrier wrapping as a belt with a personal flotation device.
Figure 11:
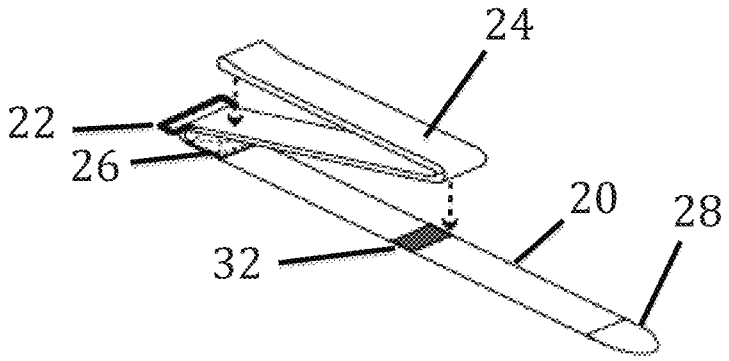
FIG. 11 shows a perspective view of a wearable sports equipment carrier making two folds to reduce the belt size.
Figure 12:
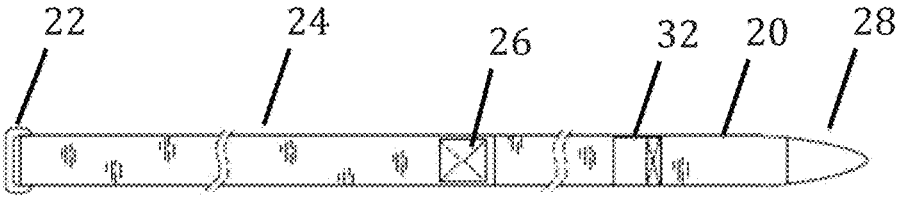
FIG. 12 shows a top plan view of the carrier.
Figure 13:
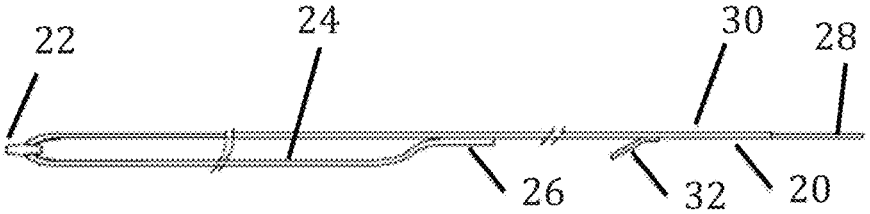
FIG. 13 shows a right elevation view of the carrier.

The wearable sports equipment carrier can also be have other items attach to it, such as a water bottle, camera, phone etc., by integrating them as part of the wearable sports equipment carrier similar to the personal flotation device 36 (as seen in FIG. 7, FIG. 8 and FIG. 10).

The foregoing discussion discloses and describes merely exemplary embodiments of the present invention. One skilled in the art will readily recognize from such discussion and from the accompanying drawings and claims that various changes, modifications and variations can be made therein without departing from the spirit and scope of the invention as defined in the following claims.

What is claimed is:

1. An equipment carrying device comprising:

a strap element comprising opposing first and second faces, said strap element having a first end, a second end and a junction point intermediate the first and second ends;

a personal flotation device (PFD) permanently affixed to the strap element; and a first buckle slidably disposed along the strap element between the first end and the junction point;

where the first face at the first end is permanently and immovably attached to the first face at the junction point to define a fixed first loop sized to receive a user's shoulder, with the buckle being positionable along the fixed first loop, and where the buckle is operable with the second end of the strap element to create a self-tightening adjustable second loop suitable for securing around an object to be carried, and where the adjustable second loop is adjustable to a size suitable for wearing the device as a belt around a waist of the user.

2. The equipment carrying device according to claim 1 further comprising a second buckle adjustably positioned along the strap element between the junction point and the second end, where the second buckle is attachable to the first buckle, thereby creating the adjustable second loop.

3. The equipment carrying device according to claim 2 wherein the first and second buckle are female and male snap-connect buckles, respectively.

4. The equipment carrying device according to claim 1 further comprising one or more fastening patches on the second face of the strap element proximal the second end, where the second end of the strap element is insertable through the first buckle and attachable at a user-selected location on the strap element via the fastening patches, thereby creating the adjustable second loop suitable, and where the fastening patches are mating pieces of hook-and-loop type fastener material.

5. The equipment carrying device according to claim 1 further comprising a weight distribution belt and a weight transfer strap, where the weight distribution belt fastens around the waist of the user, a first end of the weight transfer strap is attached to the weight distribution belt, and a second end of the weight transfer strap is adjustably attachable to the adjustable second loop so that a portion of a weight of the object is carried by the weight distribution belt.

6. The equipment carrying device according to claim 1 further comprising hook-and-loop fastening patches, on the second face of the strap element at a location halfway around the fixed first loop from the junction point, and on the first face of the strap element at a location between the junction point and the second end, where the hook-and-loop fastening patches are suitable for doubling over and securing the first fixed loop, thereby shortening a distance between the buckle and the second end to achieve improved fit when the device is worn as a belt around the waist of the user.

7. The equipment carrying device according to claim 1 wherein the PFD is a compact belt-type PFD which inflates when a handle is pulled by the user.

8. The equipment carrying device according to claim 1 wherein the PFD is permanently affixed to the strap element of the device.

9. The equipment carrying device according to claim 1 wherein the PFD includes a buckle at each end, and the PFD is connectable in series with the strap element by connecting the buckles on the ends of the PFD with the male and female buckle components of the device, respectively.

10. The equipment carrying device according to claim 9 further comprising a strap element extender attached to the female buckle component and extending the female buckle component a distance from the fixed first loop sufficient to position the PFD at a suitable location on the object to be carried.

11. The equipment carrying device according to claim 1 wherein the strap element is comprised of a polyester, polypropylene or nylon webbing material, and the webbing material has a width in a range of 1.27-7.62 centimeters (0.5-3.0 inches) and a length in a range of 0.92-3.08 meters (3.0-10.0 feet).

12. The equipment carrying device according to claim 1 wherein the junction point is located at a position approximately ⅔ of a distance from the first end to the second end of the strap element.

13. The equipment carrying device according to claim 1 wherein the first end is attached to the junction point by sewing to define the fixed first loop.

14. The equipment carrying device according to claim 1 wherein the adjustable second loop has a size suitable to carry a surfboard or a stand-up paddleboard.

15. An equipment carrying device comprising:

a strap element comprising opposing first and second faces, said strap element having a first end, a second end and a junction point intermediate the first and second ends;

a personal flotation device (PFD) permanently affixed to the strap element;

a buckle slidably disposed along the strap element between the first end and the junction point; and a plurality of fastening patches attached to the strap element, where the first face at the first end is permanently and immovably attached to the first face at the junction point to define a fixed first loop sized to receive a user's shoulder, with the buckle being positionable along the fixed first loop, and one or more of the fastening patches are provided on the second face proximal the second end, where the second end of the strap element is insertable through the buckle and attachable to a user-selected location on the strap element via the fastening patches, thereby creating an adjustable second loop suitable for securing an object to be carried, and one or more of the fastening patches are provided on the second face at a location distal from the second end, enabling the adjustable second loop to be sized for wearing the device as a belt around a waist of the user.

16. The equipment carrying device according to claim 15 wherein the adjustable second loop has a size suitable to carry a surfboard or a stand-up paddleboard.

17. The equipment carrying device according to claim 15 further comprising additional fastening patches, on the second face of the strap element at a location halfway around the fixed first loop from the junction point, and on the first face of the strap element at a location between the junction point and the second end, where the additional fastening patches are suitable for doubling over and securing the first fixed loop, thereby shortening a distance between the buckle and the second end to achieve improved fit when wearing the device as a belt around the waist of the user.

18. The equipment carrying device according to claim 15 wherein the buckle includes two slots, where the fixed first loop is permanently fitted through a first slot, and the adjustable second loop is passable through a second slot.

19. The equipment carrying device according to claim 15 wherein the fastening patches are mating pieces of hook-and-loop type fastener material.

* * * * *